US010325576B2

(12) United States Patent
Finelli, III

(10) Patent No.: US 10,325,576 B2
(45) Date of Patent: Jun. 18, 2019

(54) ELECTRONIC IDIOPHONE WITH LIGHTS

(71) Applicant: John Zachery Finelli, III, El Cajon, CA (US)

(72) Inventor: John Zachery Finelli, III, El Cajon, CA (US)

( * ) Notice: Subject to any disclaimer, the term of this patent is extended or adjusted under 35 U.S.C. 154(b) by 85 days.

(21) Appl. No.: 15/701,765

(22) Filed: Sep. 12, 2017

(65) Prior Publication Data

US 2018/0005612 A1 Jan. 4, 2018

Related U.S. Application Data

(63) Continuation-in-part of application No. 14/676,675, filed on Apr. 1, 2015, now abandoned.

(51) Int. Cl.

| | |
|---|---|
| ***G10D 13/06*** | (2006.01) |
| ***F21V 33/00*** | (2006.01) |
| ***G10D 13/02*** | (2006.01) |
| ***G10D 15/00*** | (2006.01) |
| ***G10H 3/12*** | (2006.01) |
| ***G10H 1/055*** | (2006.01) |
| ***G10H 3/14*** | (2006.01) |

(52) U.S. Cl.

CPC ..... *G10D 13/06* (2013.01); *F21V 33/0056* (2013.01); *G10D 13/02* (2013.01); *G10D 15/00* (2013.01); *G10H 1/0553* (2013.01); *G10H 3/12* (2013.01); *G10H 3/14* (2013.01); *G10H 2220/411* (2013.01); *G10H 2230/251* (2013.01); *G10H 2230/285* (2013.01)

(58) Field of Classification Search

USPC ..... 84/418

See application file for complete search history.

(56) References Cited

U.S. PATENT DOCUMENTS

| | | | | | |
|---|---|---|---|---|---|
| D211,964 | S * | 8/1968 | Valente | 84/418 | |
| D220,002 | S * | 2/1971 | Barker | 84/418 | |
| 4,269,105 | A | 5/1981 | Salmon | | |
| 4,346,637 | A * | 8/1982 | Janszen | G10D 13/06 | 84/418 |
| 5,509,343 | A | 4/1996 | Hsu | | |
| D386,779 | S * | 11/1997 | Burgos | 84/418 | |
| 5,801,320 | A * | 9/1998 | Segan | G10D 13/024 | 84/412 |
| 6,326,539 | B1 * | 12/2001 | Mishima | G10H 3/14 | 36/139 |
| D473,259 | S * | 4/2003 | Izen | D17/22 | |
| 8,168,875 | B2 | 5/2012 | Stockli | | |
| 9,263,009 | B2 * | 2/2016 | Lee | G10D 13/006 | |

* cited by examiner

*Primary Examiner* — Christopher Uhlir
(74) *Attorney, Agent, or Firm* — Andrew Morabito

(57) ABSTRACT

An electronic musical instrument comprising a lower frame member having a first end and a second end, and above the handle portion of the first end are a plurality of apertures extending through the lower frame member towards the second end, pins mounted within the plurality of apertures in predetermined locations, jingles loosely mounted to the pins, so that when the instrument is shaken a tambourine sound is emitted, an upper frame member having a first end and a second end wherein the first end of the upper frame member is attached distal to the first end of the lower frame member, at least one strip attached to the lower frame member, and an activation switch attached to the upper frame member, so that when the second end of the upper frame member and the second end of the lower frame member come in contact the strip is activated.

18 Claims, 5 Drawing Sheets

ELECTRONIC IDIOPHONE WITH LIGHTS

BACKGROUND

The present invention relates generally to the field of percussion instruments, and more particularly to an electronic tambourine with lights.

A tambourine is a typical example of an idiophone. A tambourine in general includes an annular shell having several radially through windows circumferentially spaced from each other at an equal interval and several pairs of metallic jingles arranged in the windows. One or more resonator chambers may be optionally formed in the frame at sections between adjacent windows. More specifically, each window is spanned by a fixed carrier rod which extends substantially normal to the plane of circularity of the annular shell and a pair of metallic jingles are idly inserted over the carrier rod at their centers.

When the tambourine is bashed or the tambourine is shaken by a player's hand, musical tones are generated by mutual collision of the metallic jingles and/or collision of the metallic jingles with the walls of each window fixing the carrier rod.

The tambourine has remained unchanged for many years, with the majority of its applications including a circular or crescent moon design, and even more do not allow for the ability to hook the instrument to an amplifier.

Thus, it is desired to have an idiophone that is has a comfortable shape and also allows the user to hook the idiophone to an amplifier.

SUMMARY

In one embodiment of the present invention, an electronic musical instrument comprising; a lower frame member having a first end and a second end, wherein the first end has a handle, and at least one aperture distal to the second end, a plurality of pins mounted within the at least one aperture in predetermined locations, at least one jingle loosely mounted to each of the plurality of pins, so that when the instrument is shaken a tambourine sound is emitted, an upper frame member having a first end and a second end wherein the first end of the upper frame member is attached to the lower frame member, at least one light attached to the lower frame member, and an activation switch having a first portion attached to the upper frame member and a second portion attached to the lower frame member so that when the two portions are in contact the light is activated.

In another embodiment of the present invention, an electronic musical instrument comprising; a lower frame member having a first end and a second end, wherein the first end has a handle, and a plurality of apertures extending substantially through the lower frame member are positioned above the handle and distal to the second end of the upper frame member, an upper frame member having a first end and a second end wherein the first end of the upper frame member is attached to the lower frame member, a plurality of pins mounted within the plurality of apertures in predetermined locations, a pair of jingles loosely mounted to the plurality of pins, so that when the instrument is shaken a tambourine sound is emitted, at least one light strip attached to the lower frame member, and an activation switch attached to the upper frame member and the lower frame member, so that when the second end of the upper frame member and the second end of the lower frame member come in contact the light strip is activated.

In yet another embodiment of the present invention, an electronic musical instrument comprising, a lower frame member having a first end and a second end, wherein the first end has a handle, and a plurality of apertures extending substantially through the lower frame member are positioned above the handle and distal to the second end of the upper frame member, an upper frame member having a first end and a second end wherein the first end of the upper frame member is attached to the lower frame member, a plurality of pick-ups mounted within the plurality of apertures in predetermined locations, wherein when the pick-ups sense a predetermined vibration or movement, an electrical signal is generated, at least one light strip attached to the lower frame member, and an activation switch attached to the upper frame member and the lower frame member, so that when the second end of the upper frame member and the second end of the lower frame member come in contact the LED strip is activated.

DETAILED DESCRIPTION

The present invention relates to an idiophone specifically a tambourine which allows the user to connect the tambourine to an amplifier and also allows the user to activate lights on the tambourine when playing to provide visual stimulation as well as audio. This is helpful because it allows the player to amplify the tambourine's sound as well as provide a visual show for the listeners as well.

As will be apparent to those of skill in the art upon reading this disclosure, each of the individual embodiments described and illustrated herein has discrete components and features which may be readily separated from or combined with the features of any of the other several embodiments without departing from the scope or spirit of the present invention. It is to be understood that this invention is not limited to particular embodiments described, as such may, of course, vary. It is also to be understood that the terminology used herein is for the purpose of describing particular embodiments only, and is not intended to be limiting, since the scope of the present invention will be limited only by the appended claims.

Unless defined otherwise, all technical and scientific terms used herein have the same meaning as commonly understood by one of ordinary skill in the art to which this invention belongs. Although any methods and materials similar or equivalent to those described herein may also be used in the practice or testing of the present invention, the preferred methods and materials are now described.

It must be noted that as used herein and in the appended claims, the singular forms "a", "an", and "the" include plural referents unless the context clearly dictates otherwise. It is further noted that the claims may be drafted to exclude any optional element. As such, this statement is intended to serve as antecedent basis for use of such exclusive terminology as "solely," "only" and the like in connection with the recitation of claim elements, or use of a "negative" limitation.

Figure 1:
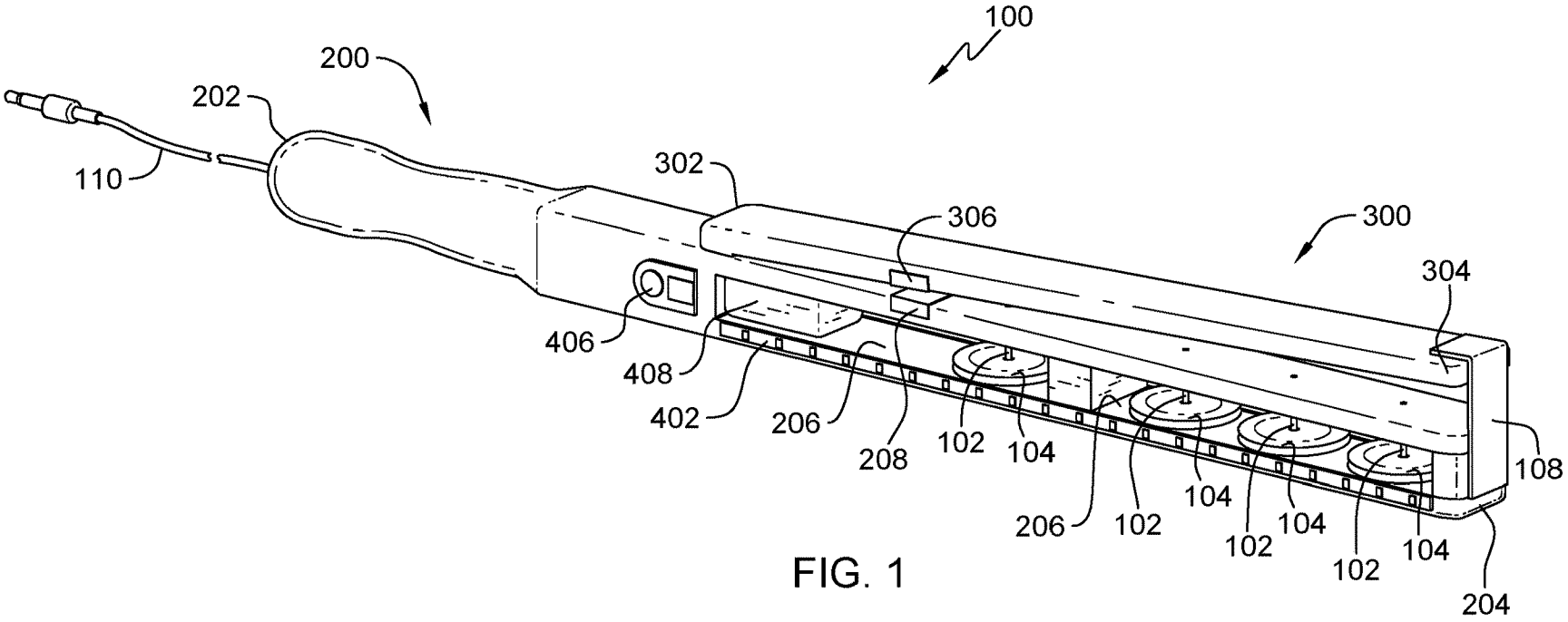
FIG. 1 depicts a perspective view of an idiophone, in accordance with one embodiment of the present invention.
Figure 2:
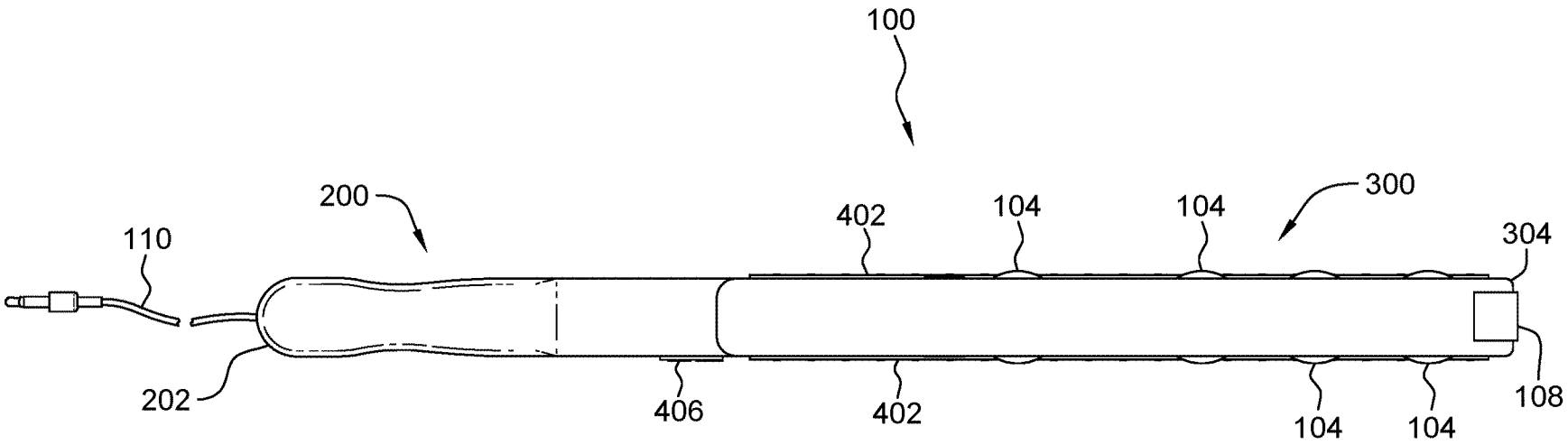
FIG. 2 depicts a top view of the idiophone, in accordance with one embodiment of the present invention.

FIGS. 1-2 depict views of the idiophone 100, in accordance with one embodiment of the present invention. The idiophone 100 is comprised of a lower frame member 200 attached to an upper frame member 300.

The lower frame member 200 is an elongated handle having a first end 202 and a second end 204. The first end 202 has an ergonomic shape to comfortably fit in a player's hand and sized to adequately house the electronic components. A predeterrmined distance from the second end 204 towards the second end 204, a plurality of apertures 206 are present. The apertures 206 are a predetermined length, width, and height. In the depicted embodiment, the apertures 206 extend entirely through the lower frame member 200 and there are two substantially rectangular apertures 206. In additional embodiments, various lengths and quantities of apertures 206 are present. The lower frame member 200 and the upper frame member 300 may be made from, but not limited to, aluminum, steel, iron, copper, brass, bronze, zinc, stainless steel, polyolefins, styrenics, polypropylene, copolymer polypropylene, polystyrene, thermoplastic elastomers, thermoplastic elastomers, polyethylene, polypropylene, polystyrene, copolymer polypropylene, or the like.

In each aperture 206, there are a plurality of pins 102 mounted a predetermined distance from one another. Attached to the pins 102 are at least a set of jungles 104. The sets of jingles 104 are what creates the noise of the idiophone 100. In some embodiments, there are more than one set of jingles 104 on each pin 102. In additional embodiments, the jingles 102 and the pins 102 are removed and replaced with an electrical component that is able to transform the movement of the idiophone into various electrical noises with the assistance of synthesizers and other computer programing. Each set of jingles 102 has a substantially center mounted opening, which the pin 102 passes through. In the depicted embodiment, the jingles of each set are substantially the same. In various embodiments, the jingles have predetermined shapes and sizes based on the desired sound. In the depicted embodiment, there are four pins 102 and four sets of jingles 104. In additional embodiments, more pins 102 and jingles 104 of varying shapes and sizes may be employed to provide varying sounds.

Attached to the lower frame 200 is a plurality of light strips 402. The light strips are mounted on the lower frame 200 and do not interfere with the sets of jingles 104 or the handle on the first end 202 of the lower frame member 200. In the depicted embodiment, the light strips 402 are attached to the lower frame 200 along the edge below the apertures 206. In various embodiments, the light strip 402 may be mounted to various parts of the idiophone 100. In the depicted embodiment, light strips 402 are light emitting diodes (LED). In additional embodiments, various types of lighting strips of varying colors may be used.

Pivotally attached to the lower frame member 200 is the upper frame member 300, having a first end 302 and a second end 304. The first end 302 of the upper frame member 300 is securely attached to the first end 202 of the lower frame member 200. This is accomplished by a pin, screw, or other locking mechanism. In additional embodiments, the upper frame member 300 and the lower frame member 200 are a unitary element. The second end 304 of the upper frame member 300 and the second end 204 of the lower frame member 200 are secure using a latch 108. The latch 108 is used to keep the upper frame member 300 from traveling beyond a predetermined distance from the lower frame member 200. This assists in shortening the distance traveled to activate the light strip 402. In the depicted embodiment, a strap of cloth is attached from the upper frame member 300 to the lower frame member 200. In additional embodiments, various materials or latches may be used to keep the upper frame member 300 and the lower frame member 200 together. In some embodiments, there is no latch 108.

In the depicted embodiment, an electric connection 110 is shown extending from the based on the lower frame member 200 at the first end 202.

In the depicted embodiment, a first switch pad 208 is shown attached to the lower frame member 200 and a second switch pad 306 is shown attached to the upper frame member 300. In use, when the upper frame member 300 is pressed downwards towards the lower frame member 200, the two switch pads 208 and 306 touch, completing the electrical circuit (in combination with other elements listed below in FIG. 5), to activate the light strips 402. This allows the operator the freedom to activate the light strips 402 at their discretion.

In some embodiments, the first end 204 of the lower frame member 200 has a soft material covered the a portion of the first end 202 of the lower frame member 200 to provide a more comfortable experience for the player.

Figure 3:
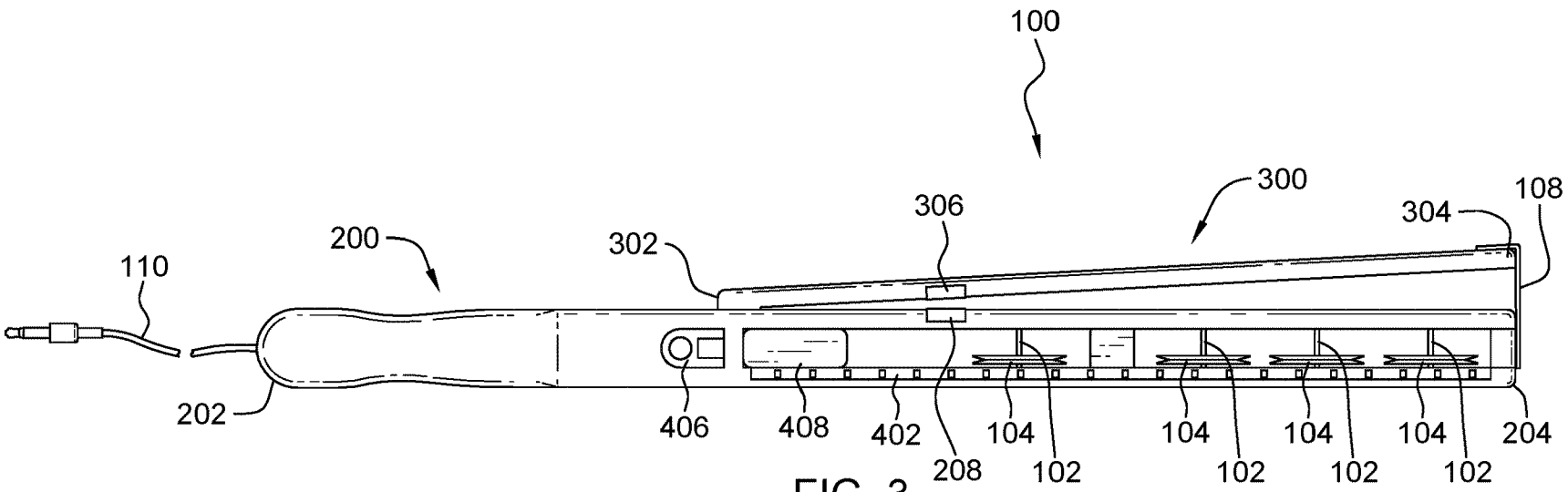
FIG. 3 depicts a front view of the idiophone in a deactivated, in accordance with one embodiment of the present invention.

FIG. 3 depicts a front view of the idiophone 100 in the deactivated, in accordance with one embodiment of the present invention. In the depicted embodiment, the upper frame member 300 and the lower frame member 200 are separated from one another, and an two switch pads 208 and 306 are not in contact with one another. The switch pads 208 and 306 may be various types of button switches, electrical plates, or other forms known to one skilled in the art and may be positioned in various locations along the upper frame member 300 and the lower frame member 200 provided that when the two frame members come in contact the switch pads 208 and 306 complete the circuit and activate the light strip 402.

Figure 4A:
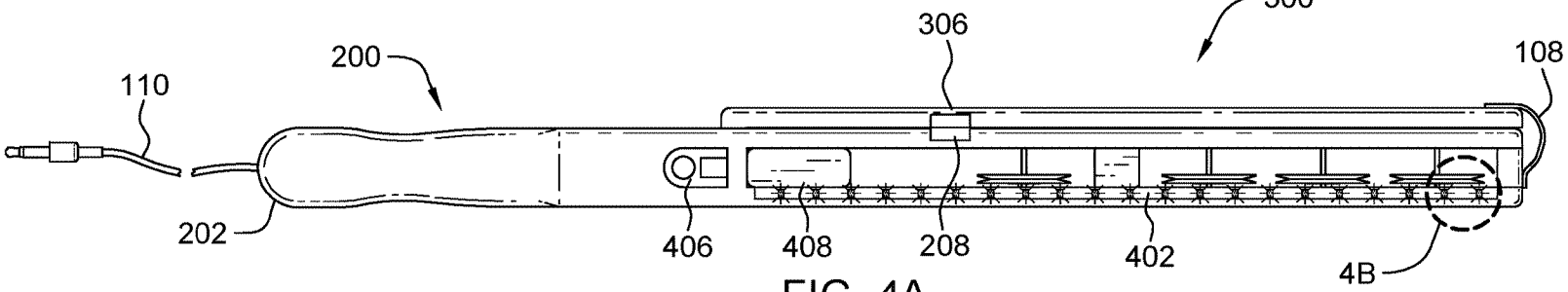
FIG. 4A depicts a front view of the idiophone in the activated position, in accordance with one embodiment of the present invention.
Figure 4B:
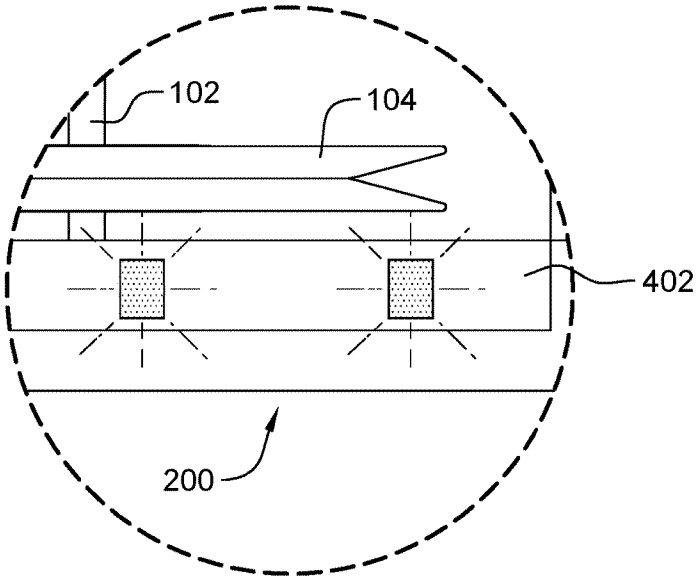
FIG. 4B depicts a detailed view of the idiophone in the activated position, in accordance with one embodiment of the present invention.

FIGS. 4A and 4B depicts a front view of the idiophone in the activated position, in accordance with one embodiment of the present invention. In the depicted embodiment, the upper frame member 300 and the lower frame member 200 are pressed together, activating the switch pads 208 and 306 thereby activating the light strip(s) 402. In the shown embodiment, the upper frame member 300 and the lower frame member 200 are designed to separate so that the switch pads 208 and 306 are not in contact, thereby giving the player the control over the activation of the lights. This activation process can be performed by the player pressing the two frame members 200 and 300 together. In the preferred embodiment, this can be accomplished with minimal pressure and performed with one hand by the player. In additional embodiments, the upper frame member 300 may have a lock or securing means so that the light strip 402 may remain activated.

Figure 5:
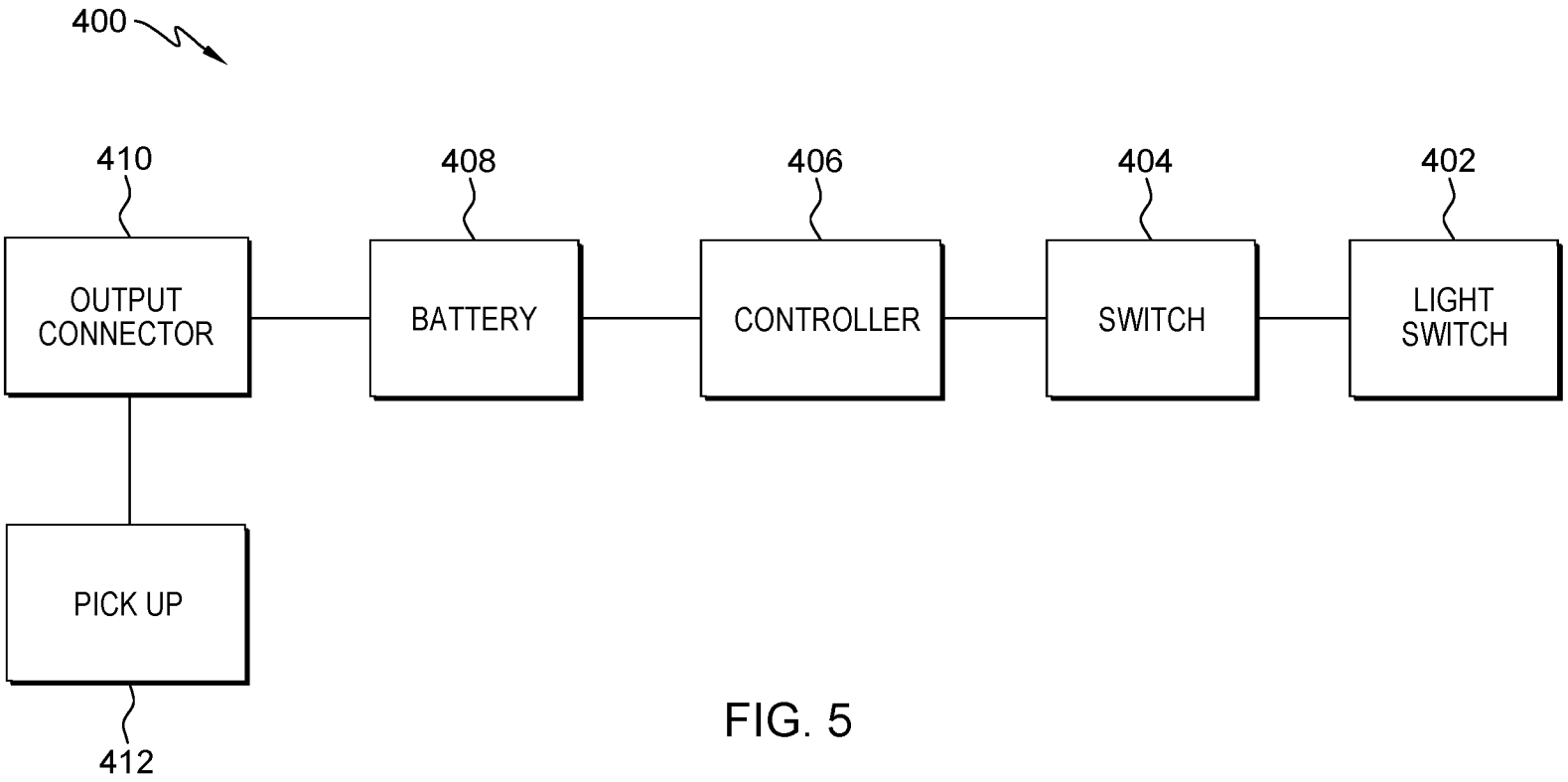
FIG. 5 depicts a block diagram showing the circuit, in accordance with one embodiment of the present invention.

FIG. 5 depicts a block diagram of an electronic system 400 of the idiophone 100, in accordance with one embodiment of the present invention. The electronic system of the idiophone 100 is comprised of at least one light strip 402, an activation switch 404, a controller 406, a battery 408, an output connector 410, and at least one electrical pick-up 412. In additional embodiments, a cable, or volume knobs may be incorporated into the design.

The pick-ups 412 aye transducers that capture or sense mechanical vibrations produced by the sets of jingles 104 and translates this vibration into an electronic signal. Various types of pick-ups may be used, such as vibration or magnetic pick-ups, or those known to one skilled in the art. The pick-ups 412 are positioned in and on the idiophone 100 to best sense the movement and vibrations of the various sets of jingles 104. In some embodiments, the pick-ups 412 are connected to the switch 404 to activate the light strips 402 when the idiophone 100 makes a noise or sound.

In some embodiments, the pick-ups 412 may be used to replace the jingles 104 in the apertures 206 so that the user can connect the idiophone 100 to a computer an create the desired noise or sound with the idiophone 100.

The output connector/audio jack 410 is used to connect the idiophone 100 to a speaker or amplifier. In the preferred embodiment, the audio jack 410 is exposed out of the first end 202 of the lower frame member 200. This provides an easily accessible and not intrusive position for the cable to be attached. The cable is of a predetermined length, or may be attached to a wireless transmitter to allow the player a more wireless experience.

The battery 408 is used to power the idiophone 100. Various types of batteries may be used, such as alkaline, lithium, zinc-carbon, and the like. The battery 406 may also be rechargeable and have the necessary ports to connect to a power source. In the depicted embodiment, the battery 408 is positioned in the aperture 206. In various other embodiments, the battery 408 may be substantially contained within the lower frame member 200.

The controller 406 is used to control the light strips 402. The controller 406 may be used to adjust the color of the light strip 402, a pulse or oscillating settings of the light strips 402, or various other features of the light strips 402. In the shown embodiment, the controller 406 is inserted into the handle of the lower frame member 200. In additional embodiments, the controller 406 may be positioned in various locations based on the size, shape, and design of the idiophone 100.

The switch 404, is shown as switch pads 208 and 306 in the previous FIGS. 1-4). The switch 404 is used to activate the light strips 402 at the players discretion.

The invention is inclusive of combinations of the embodiments or embodiments described herein. References to "a particular embodiment" or "embodiment" and the like refer to features that are present in at least one embodiment of the invention. Separate references to "an embodiment" or "particular embodiments" or "embodiments" or the like do not necessarily refer to the same embodiment or embodiments; however, such embodiments are not mutually exclusive, unless so indicated or as are readily apparent to one of skill in the art. The use of singular or plural in referring to "method" or "methods" and the like is not limiting. The word "or" is used in this disclosure in a non-exclusive sense, unless otherwise explicitly noted.

While this invention has been described in conjunction with the specific embodiments outlined above, it is evident that many alternatives, modifications and variations will be apparent to those skilled in the art. Accordingly, the preferred embodiments of the invention, as set forth above, are intended to be illustrative, not limiting. Various changes may be made without departing from the spirit and scope of this invention. The present invention shall be easily carried out by an ordinary skilled person in the art, and any modifications and changes are deemed to be within the scope of the present invention.

This written description uses examples to disclose the invention, including the best mode, and also to enable any person skilled in the art to practice embodiments of the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

All publications and patents cited in this specification are herein incorporated by reference as if each individual publication or patent were specifically and individually indicated to be incorporated by reference and are incorporated herein by reference to disclose and describe the methods and/or materials in connection with which the publications are cited. The citation of any publication is for its disclosure prior to the filing date and should not be construed as an admission that the present invention is not entitled to antedate such publication by virtue of prior invention. Further, the dates of publication provided may be different from the actual publication dates which may need to be independently confirmed.

What is claimed is:

1. An electronic musical instrument comprising:

a lower frame member having a first end and a second end, wherein the first end has a handle, and at least one aperture distal to the second end;

a plurality of pins mounted within the at least one aperture in predetermined locations;

at least one jingle loosely mounted to each of the plurality of pins, so that when the instrument is shaken a tambourine sound is emitted;

an upper frame member having a first end and a second end wherein the first end of the upper frame member is attached to the lower frame member;

at least one light attached to the lower frame member; and an activation switch having a first portion attached to the upper frame member and a second portion attached to the lower frame member so that when the two portions are in contact the at least one light is activated.

2. The electronic musical instrument of claim 1, further comprising a grip at the first end of the lower frame member.

3. The electronic musical instrument of claim 1, further comprising an electrical system to convert the sound emitted by the shaking of the electronic musical instrument to an electronic sound.

4. The electronic musical instrument of claim 1, further comprising a latch attached to the second end of the lower frame member and the second end of the upper frame member, wherein the latch permits the upper frame member to travel a predetermined distance from the lower frame member.

5. The electronic musical instrument of claim 1, wherein the first portion and the second portion of the activation switch are substantially aligned.

6. The electronic musical instrument of claim 1, further comprising a controller connected to the at least one light to manually adjust various features of the at least one light.

7. The electronic musical instrument of claim 1, further comprising one of the at least one light attached to the upper frame member.

8. The electronic musical instrument of claim 1, wherein the upper frame member is detachable from the lower frame member.

9. An electronic musical instrument comprising:

a lower frame member having a first end and a second end, wherein the first end has a handle, and a plurality of apertures extending substantially through the lower frame member positioned distal to the handle and the second end an upper frame member having a first end and a second end wherein the first end of the upper frame member is joined to the lower frame member, wherein the upper frame member and the lower frame member form a single component;

a plurality of pins mounted within the plurality of apertures in predetermined locations;

a pair of jingles loosely mounted to the plurality of pins, so that when the instrument is shaken a tambourine sound is emitted;

at least one light strip attached to the lower frame member; and an activation switch attached to the upper frame member and the lower frame member, so that when the second end of the upper frame member and the second end of the lower frame member come in contact the at least one light strip is activated.

10. The electronic musical instrument of claim 9, further comprising a grip at the first end of the lower frame member.

11. The electronic musical instrument of claim 9 further comprising a latch attached to the second end of the lower frame member and the second end of the upper frame member, wherein the latch permits the upper frame member to travel a predetermined distance from the lower frame member.

12. The electronic musical instrument of claim 9, further comprising a battery substantially enclosed within the first end of the lower frame member, wherein the battery is used to power the at least one light strip.

13. The electronic musical instrument of claim 9, further comprising an LED strip attached to the upper frame member.

14. The electronic musical instrument of claim 9, wherein the upper frame member is detachable from the lower frame member.

15. The electronic musical instrument of claim 13, further comprising at least one pick-up mounted within at least one of the plurality of apertures, wherein when the pick-ups sense a vibration or movement, an electrical signal is generated.

16. The electronic musical instrument of claim 15, wherein, when the second end of the upper frame member and the second end of the lower frame member come in contact, the LED strip is activated.

17. The electronic musical instrument of claim 9, further comprising at least one pick-up mounted within at least one of the plurality of apertures, wherein when the pick-ups sense a vibration or movement, an electrical signal is generated.

18. The electronic musical instrument of claim 13, wherein, when the second end of the upper frame member and the second end of the lower frame member come in contact, the LED strip is activated.

* * * * *